US010843063B1

(12) United States Patent
Taylor, Jr.

(10) Patent No.: US 10,843,063 B1
(45) Date of Patent: Nov. 24, 2020

(54) PLAYING CARD SHUFFLER

(71) Applicant: James Scott Taylor, Jr., Monterey, CA (US)

(72) Inventor: James Scott Taylor, Jr., Monterey, CA (US)

( * ) Notice: Subject to any disclaimer, the term of this patent is extended or adjusted under 35 U.S.C. 154(b) by 0 days.

(21) Appl. No.: 16/030,817

(22) Filed: Jul. 9, 2018

(51) Int. Cl.
*A63F 1/14* (2006.01)
*A63F 1/12* (2006.01)

(52) U.S. Cl.
CPC ..... *A63F 1/12* (2013.01)

(58) Field of Classification Search
CPC ..... A63F 1/00
See application file for complete search history.

(56) References Cited

U.S. PATENT DOCUMENTS 205,030 A * 6/1878 Ash ..... A63F 1/12
273/149 R

* cited by examiner

*Primary Examiner* — Sunit Pandya

(57) ABSTRACT

An apparatus for shuffling playing cards comprising: a block of plastic, metal, an enclosure, top, bottom portion, and sidewalls; top portion configured to insert two decks of cards; a plurality of rods, geometrically shaped, elliptical and rectangular, extending perpendicular from base, upper surface of rods is interleaved between the slots, rods are spaced apart, horizontally, vertically, and congruently; slots arranged between pairs of rods, such that a slot spacing is defined by a distance between associated pairs of rods; the plurality of vertical rods (group A) aligns to newer cards; and the plurality of horizontal rods (group B) aligns to used cards; (group A) is perpendicular, and congruent to (group B); the slot spacing between (group B) is wider than (group A); pivot base for proper alignment of cards to rod/slots for shuffling; a water absorbent coaster on bottom, rubber discs on top, inverts to a drink holder.

16 Claims, 1 Drawing Sheet

FIG. 1
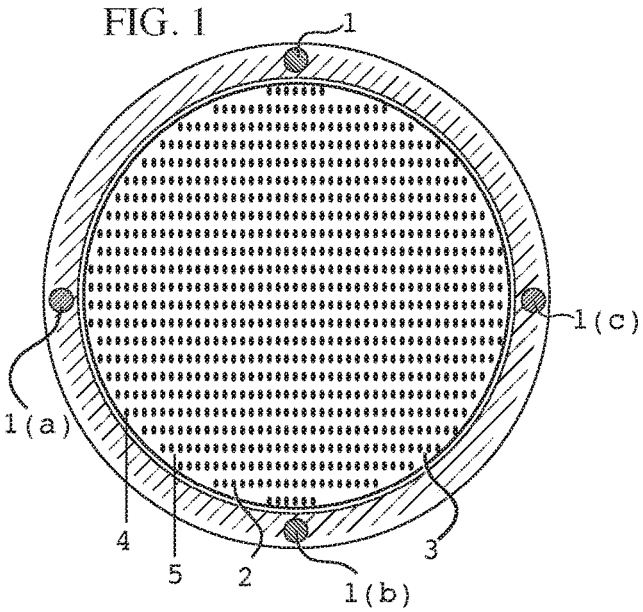
FIG. 2
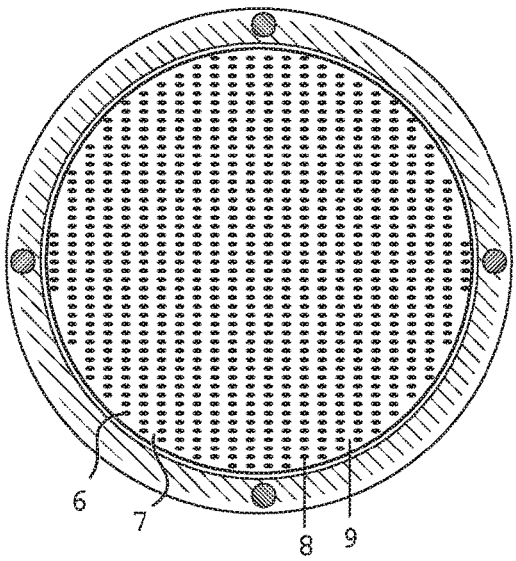
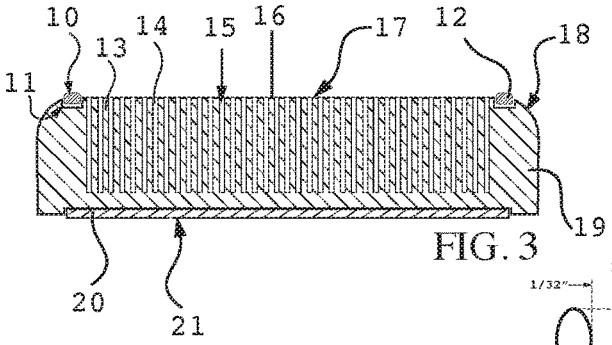
FIG. 3
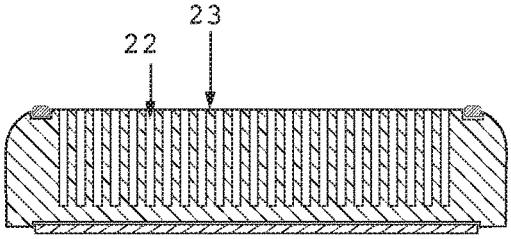
FIG. 4
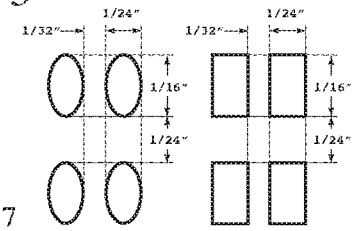
FIG. 6
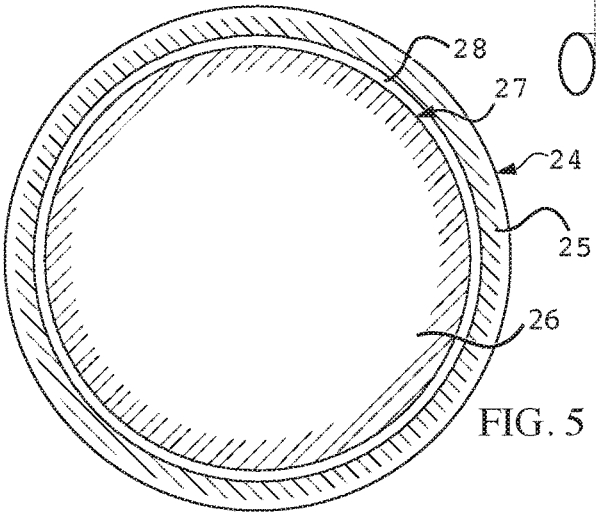
FIG. 5
FIG. 7
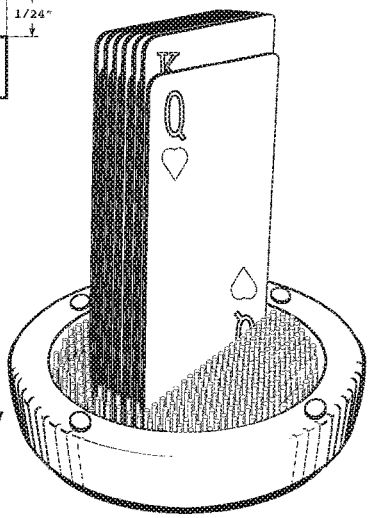

PLAYING CARD SHUFFLER

DESCRIBE HOW INVENTION ADDRESS TECHNICAL PROBLEMS

The invention for shuffling playing is an innovative achievement from prior art, in the field of shuffling playing cards: Although prior art addresses an enclosure, a top, a bottom portion, and plurality of sidewalls. The invention comprising a plurality of equally spaced apart geometrically shaped rods, elliptical and rectangular, extending from a base arranged in rows of rods and slots arranged vertically (group A) and rows of rods and slots arranged horizontal (group B). The arrangement of slot and rods of (group A) and the arrangement of slot and rods of (group B) allows playing cards of various condition such as new to lightly played (newer) and playing cards of moderately played to heavily played (worn) condition to be inserted into enclosure without an modification. Said new to lightly played playing cards inserted into the narrow slots of (group A), and the said moderately played to heavily played playing cards inserted into the wider slots of (group B) arranged perpendicular to (group A) Slots arranged between pairs of said rods, such that a slot spacing is defined by a spaced apart distance between associated pairs of rods and where an upper defined surface of the rods is interleaved between the slots; both groups of rods and slots are congruent and interleaved top surface. The slots are arranged to enable separation of two deck of cards. The cards are inserted in enclosure, jiggle and manipulating the cards such that a first plurality of cards enters the slots and a second plurality of cards remains in a space defined by the upper surface of the rods; separating the first plurality of cards from the second plurality of cards; tacking the first plurality of cards on the second plurality of cards to regroup the deck of cards; and completing the shuffling of the deck of cards. When a deck of cards become worn and unable to pass through the narrow slots of (group A), pivot the apparatus 90 degrees at base and insert into the wider slots and the wider width rods. The slot spacing between horizontal rows of rods (group B) is wider than the slot spacing between the vertical rows of rods (group A) which are perpendicular to (group B). Moreover the invention comprised of geometrically shaped rods, horizontal and vertical extending from base and no separators as prior art illustrates.

The invention further comprises a water absorbent material (beverage coaster) on said bottom of apparatus wherein label, logo, marketing information about the said apparatus. The invention further configured wherein comprising a top portion a plurality of rubber discs (non-skid material) on top surface. This modification would prevent the invention when inverted from sliding when a drink is set upon on the said drink coaster. Another accomplishment of the invention from prior art, in the field of shuffling playing cards: A hollowed block of plastic, metal of a circular low profile, flat shape, a top portion comprising a outer edge is rounded, a plurality of equally spaced apart substantially parallel rods extending perpendicular from base wherein the rods each have an upper surface. The plurality of vertical row of rods of (group A), and a plurality of horizontal rows of rods (group B) is perpendicular, and congruent to (group A). The said rods are geometrically shaped, elliptical and rectangular. The slots arranged between pairs of said rods, such that a slot spacing is defined by a spaced apart distance between associated pairs of rods and wherein an upper surface of the rods is interleave between the slots; and the slots arranged to enable separation of two decks of cards such that when the decks of said cards is inserted into the enclosure, wherein cards aligning on said horizontal rows of rods and aligning on vertical rows of rods. (Group A) wherein the minor axis width side of rods align to edge of cards of new to lightly played (newer) condition; and (group B) wherein the major axis length side of rods align to playing cards of moderately played to heavily played (worn) condition. The slot spacing between rods of (group A) is narrow and less wide compared to the slot spacing between rods of (group B). The shuffling commences as the apparatus is pivoted from base to obtain correct desired slot width for shuffling playing cards. Cards of said newer condition insert into the narrow slots and less wide rods of (group A), and the cards of said worn condition is inserted into the wider slots and wider rods of (group B). Another accomplishment of the invention wherein a low profile, (pocket-size) is very compact, well suited for travel, and requires no batteries. The invention allows playing cards to remain straight thought the shuffling process.

Another accomplishment allow a person of compromised physical condition to be able to shuffle with one hand, and persons with arthritis or trouble physically shuffling, this invention comprising a low profile make it easy to shuffle and is also therapeutic. Both hands resting on the same surface that the apparatus is resting, holding the cards edges with both hands cupping around the apparatus on allows the ability for a comfortable shuffle and relaxing shuffle for persons whom may have trouble shuffling.

LIST OF FIGURES

The invention comprising: a circular hollow block of plastic, metal, an enclosure for receiving two decks of playing cards, a top portion configured to enable the insertion of two decks of cards into the enclosure, a bottom portion comprising a water absorbent material (beverage coaster) on said bottom of apparatus wherein label, logo, marketing information about the said apparatus. A plurality of broad sidewalls, a top portion comprising a rounded edge, ergonomically shaped, for he purpose of a comfortable shuffle. A plurality of equally spaced apart substantially parallel rods extending perpendicular from base wherein the rods each have an upper surface. Rods arranged wherein a plurality of vertical rows of rods (group A), and a plurality of horizontal rows of rods (group B), wherein (group B) is perpendicular and congruent to (group A). plurality of geometrically shaped, elliptical and rectangular rods arranged for the purpose of shuffling new to lightly played (newer) condition and playing cards of moderately played to heavily played (worn) condition. Said newer cards inserted into enclosure comprising the arrangement of the narrow slots and rods wherein top align to the narrow width of (group A) rods. Said worn cards inserted into arrangement of the wide slots wherein top align to the wide length of (group B) rods. A plurality of slots arranged between pair of said rods, such that a slot spacing is defined by a spaced apart distance between associated pairs of rods, and wherein an upper surface of the rods is interleaved between the slots. Slots are arranged to enable separation of two deck of cards such that when the deck of cards is inserted into the enclosure, a group of cards lower into the slots and an upper group rests on the defined upper top surface. A beverage coaster projecting at bottom surface, with label, logo indicating marketing information such as licensing and self promotion material, said coaster for the purpose of resting a drink when apparatus in inverted. A plurality of non-skid discs at top surface, wherein apparatus is inverted allows a secure base and preventing apparatus from sliding while a drink is resting on said coaster.

A DETAILED DESCRIPTION OF INVENTION

An apparatus for shuffling playing cards comprising: a hollow block, (box) of plastic, metal of a circular, flat shape, a top portion, a bottom portion, and a plurality of sidewalls, the top portion configured to enable the insertion of two decks of playing cards into the enclosure, wherein a plurality of equally spaced apart substantially parallel rods extending perpendicular from base, the plurality of said rods are geometrically shaped, elliptical and rectangular; wherein the rods each have an upper surface; rods and slots of (group A) are perpendicular and congruent to the rods and slot of (group B); slots arranged between pairs of said rods, such that a slot spacing is defined by a spaced apart distance between associated pairs of rods, and the rods are interleaved to top upper surface. The slots arranged to enable the insertion of two decks of cards when the decks of cards is inserted into the enclosure and wherein cards aligning on horizontal rows of rods and slots and aligning on vertical rows of rods, the cards are divided into separable plurality of cards with a lower group passing into the slots and an upper group resting on the upper surface of the rods enabling the upper group to be easily separated from the lower group. Said rods of (group A) wherein the minor axis or width side of rods align to the edge of cards of new to lightly played (newer) condition, and the said rods (group B) wherein the major axis length side of rods align to the edge of cards of moderately played to heavily played (worn) condition. The bottom surface of apparatus comprising, a water absorbent material (drink coaster) wherein a label, logo, marketing information about the said apparatus. Further comprising a plurality of rubber discs (non-skid material) projecting from top surface, when the apparatus is inverted a said drink coaster is positioned for the purpose to nest a drink/beverage. A top surface comprising a plurality of rubber disc wherein the apparatus is inverted allows for apparatus to stay and not slide when a drink is set upon said drink coaster.

To start shuffling; pivot base of apparatus for the proper alignment of cards to rods/slots. (Group A) slots and rods is reserved for the insertion of playing cards of new to lightly played (newer) condition. Slots and rods of (group B) comprising wider slots and the wider length side of rods is reserved for the insertion of playing cards of moderately played to heavily played (worn) condition. Insert the deck of cards into the enclosure, slightly jiggle and manipulating the cards such that a first plurality of cards enters the slots, and a second plurality of cards remains in a space defined by the upper surface of the cards. The cards are divided into separable plurality of cards, with a lower group passing into the slots, and an upper group resting on the upper surface of the rods, enabling the upper group to be easily separated from the lower group. Separating the first plurality of cards from the second plurality of cards. Then stack the first plurality of cards on the second plurality of cards, to regroup the deck of cards. Repeating the process at least one once. For an advanced shuffle; after cards have been divided into separable groups, stack the first plurality of cards in front of the second plurality of cards, reshuffle, then stack the first plurality of cards in back of the second plurality of cards. This allows the cards on both ends to get shuffled into the decks of cards. Comprising on a top surface of apparatus; a rounded upper top outside edge, ergonomically designed for a comfortable shuffle; allowing hands to rest on the same surface as the apparatus is resting on. The dimension of the apparatus is four inches a round in width and length, or there-abouts the height varies from three quarter of an inch to one and one half inches. A sub-set of said apparatus is rectangular in shape, also comprising a rounded upper top outside edge. The sub-set comprising a width and length of four inches square. The height varies from three quarters of an inch to one and one half inches. Bottom portion of apparatus comprising a water absorbent material (drink coaster) indicating label with logo and marketing material. The top of said apparatus comprised a plurality of non-skid discs of a non-skid material, for the purpose, when the apparatus is inverted, said drink coaster is reviled and becomes the top surface for the purpose to support and nest a drink.

FIG. 1 a top view of the card shuffler wherein said vertical rods and slot said (group A), also refereed to as second group in claims, align left to right, embodying the features of the present invention; Playing cards of new to lightly played (newer), align to the said rods and slots of FIG. 1 (North/South axis; refer to drawings of the invention FIG. 1). Apparatus is constructed of plastic (a jet-mold injected) and metal (a die cast process). Plastic is for economics, where as the metal construction is for the marketability of the higher scale.

1. Rubber discs (non-skid) 1(*a*), (*b*), (*c*), discs measurement three-sixteenth of an inch round wherein the discs attach to the top surface into the one quarter of an inch wide, one eighths deep aperture on top upper surface. Arranged parallel to the rods and slots horizontal and vertical. positioned at (12, 3, 6 and 9 O'clock) top outer edge.

2. Vertical rods (group A). All rod are the geometrically shaped measure one sixteenth of an inch by one twenty-forth of an inch (1/16"×1/24"), and are one-half (1/2") of an inch high from base to top defined upper surface, both said elliptical rods and the rectangular (sub-set) rods, both measure the same dimension (1/16 of an inch by 1/24 of an inch), Said rods measure 35° elliptical degrees in shape or thereabouts and extend from base.

3. Vertical slots (group A) between vertical rods, measurement is one-thirty second (1/32") of an inch wide.

4. Direction playing cards are placed to align onto rods, is in a forward direction, cards edges facing away, (hands out, cupping the deck of playing cards).

5. Direction playing cards are placed to align into slots in enclosure, and a plurality of cards are lowered into one-thirty second (1/32") of an inch slots, the position the playing cards of new to lightly played (newer) align a plurality of cards align to said rods (1/24"). Cards edges facing forward, then jiggled and manipulated cards in order for a plurality of the said group of cards to release and lower into the enclosure aligning to inside bottom base of enclosure.

FIG. 2 a top view of the card shuffler, wherein said playing cards of moderately played to heavily played (worn) align to the said rods and slots of FIG. 2 (North/South axis; refer to drawings of the invention FIG. 2). By changing the orientation of FIG. 1, (for said newer cards), ninety degrees to the arrangement of FIG. 2, orientation allowing for playing cards of moderately played to heavily played (worn) cards to be aligned and inserted into the enclosure of FIG. 2, (North and South axis, respectively wherein said horizontal rods and slot (group B) align left to right, perpendicular to (group A), embodying the features of the present invention.

6. Comprising Horizontal rods and orientation. All rod are the geometrically shaped measure one sixteenth of an inch by one twenty-forth of an inch (1/16"×1/24"), and are one-half of an inch (1/2") in height, from base to top defined upper surface, both said elliptical rods and the rectangular (sub-set) rods, both measure the same dimension (1/16 of an inch by 1/24 of an inch). It is the different equally spaced apart distance wherein determines the slot spacing distance.

7. Horizontal slots (group B) between said horizontal rods, measurement is one-twenty forth of an inch (1/24").

8. Direction playing cards are placed to align onto rods (1/16") and lower into the said 1/24" slots, the position the playing cards edges are to be, forward in direction, edge facing away and then jiggled and manipulated cards in order for the said cards to release and lower into the enclosure down into the enclosure.

9. Direction playing cards are placed to align into slots in enclosure and lower into (1/24") of an inch slots, the position the playing cards are to be, forward edge facing and then jiggled and manipulated in order for the said cards to release from deck and lower into the enclosure.

FIG. 3 is the sectional side view of the card shuffler depicted in FIG. 1 wherein vertical rods and slot (group A) align left to right, embodying the features of the present invention;

10. Comprising: rubber discs (non-skid) Top surface rubber discs wherein apparatus is inverted the said rubber discs surface become the base for the said drink holder, wherein there is a surface to rest a drink. Turn apparatus over again for the proper orientation for the playing card shuffler apparatus.

11. a small (1/4") aperture. wherein Rubber discs are inserted and secured with adhesive.

12. Comprising: rubber discs (non-skid) a plurality of discs measurement three-sixteenth of an inch, (3/16"), round wherein the discs attach to the top surface into a plurality of the one quarter of an inch wide, one eighths deep aperture on top upper surface. A plurality arranged parallel to the rods and slots horizontal and vertical, positioned at left and right sides on top outer edge.

13. Comprising Vertical rods (group A). All rod are geometrically shaped measure one sixteenth of an inch by one twenty-forth of an inch (1/16"×24"), and are one-half (1/2") of an inch in height from inside base to top defined upper surface. Both said elliptical rods and the rectangular (sub-set) rods, both measure the same dimension (1/16 of an inch by 1/24 of an inch), 14. Slots between Vertical rods (group A), measurement is one-thirty second (1/32") of an inch wide and arranger for the insertion of new to lightly played playing cards.

15. Direction playing cards are placed to align into vertical slots (group A) a downward direction, jiggle and manipulate deck of cards as a plurality of cards lower into the said slots and align to the inside base (one-half inch) into the enclosure 16. Direction playing cards are placed to align onto vertical rods (group A) a downward direction, a plurality of cards top align to the said upper defined top upper surface wherein upper group of cards rest.

17. Top upper portion is the mid point location wherein a plurality of cards align to the said rods and a second plurality of cards lower into the enclosure.

18. Rounded Edge measures one-eighth of an inch (1/8") quarter round of a circle.

19. Apparatus is constructed of plastic (jet-mold injected) and metal (die cast). Plastic is for economics, and the metal apparatus is for the marketability of the higher scale.

20. water absorbent drink coaster measurement is a standard three and one-half inches (3½") wide and circular shaped, and a standard forty point thickness (40 pt.), 21. Top surface of water absorbent drink coaster standard forty point thickness (40 pt.), and a standard circular three and one-half inch (3½") wide. Top surface is for the purpose of wherein the apparatus is inverted, allows for a drink to rest on said surface.

FIG. 4 is the sectional side view of the card shuffler depicted in FIG. 2 wherein horizontal rods and slot (group B) align left to right, embodying the features of the present invention;

FIG. 4 is the sectional side view of the card shuffler depicted in FIG. 2 wherein horizontal rods and slot (group B) align left to right, embodying the features of the present invention;

22. Slots between horizontal rods orientation are one twenty-forth of an inch wide (1/24") (group B) a downward direction, jiggle and manipulate deck of cards as a plurality of cards lower into the said slots and align to the inside base one-half of an inch (1/2") into the enclosure.

23. Comprising Horizontal rods measuring one-sixteenth (1/16") of an inch wide, direction playing cards are placed to align onto vertical rods (group A) a downward direction, a plurality of cards top align to the said upper defined top upper surface.

FIG. 5 is a bottom view of the card shuffler depicted in FIG. 1 and FIG. 2 and illustrating the construction of the base;

24. Outside parameters of apparatus.

25. The body of apparatus is constructed of plastic (jet-mold injected) and metal (die cast). Plastic is for economics, and the metal apparatus is for the marketability of the higher scale model. Bottom side of apparatus.

26. top surface of water absorbent drink coaster standard forty point thickness (40 pt.), and a standard three and one-half inch wide. Top surface is for the purpose of wherein the apparatus is inverted, allows for a drink to be rest on a said surface.

27. Outer edge of water resistant drink coaster aligns to the a debossed flat inset surface edge, an additional debossed logo is in bedded into said surface.

FIG. 6 The geometrically shaped rods measure 1/16 of an inch by 1/24 of an inch, both said elliptical rods and the rectangular (sub-set) rods, both measure the same dimension. Playing cards of new to lightly played (newer), align to the said rods and slots of FIG. 1 (North/South axis; refer to drawings of the invention FIG. 1). Wherein said playing cards of moderately played to heavily played (worn), align to the said rods and slots of FIG. 2 (North/South axis; refer to drawings of the invention FIG. 2). By changing the orientation of FIG. 1, (wherein reserved for said newer cards, ninety degrees to the orientation of FIG. 2, this orientation allowing for said worn cards to be aligned and inserted into the enclosure of FIG. 2, (North and South axis) restrictively.

FIG. 7 A three-quarters elevated view of the apparatus, with representation of a deck of playing cards having been inserted into the enclosure, with a plurality of cards resting on the upper rod surface and a plurality of cards lowered into the enclosure and described in detail in the claims section.

The drawings are to be understood to be more or less a schematic character for the purpose of illustrating and disclosing a typical or preferred form of the improvements contemplated herein, and in the drawings, like reference characters identify the same parts in the several views. in a sectional view of the card shuffler depicted in FIG. 1 and FIG. 2 illustrating the relative disposition of the playing cards in shuffling operation.

To reiterate the claim of the invention: playing card shuffler apparatus comprising: a block, hollowed, having an enclosure, a top portion, a bottom portion, and a plurality of sidewalls, the top portion configured to enable the insertion of two decks of cards into the enclosure; a plurality of equally spaced apart rods extending perpendicular from base, wherein the rods each have an upper surface; a plurality of said rods arranged wherein a plurality of the first group of rods is congruent to a plurality of the second group of rods; the plurality of rods equally spaced apart, and said rods are geometrically shaped; slots arranged between pairs of said rods, such that a slot spacing is defined by a spaced apart distance between associated pairs of rods and wherein an upper defined surface of the rods is interleaved between the slots; and the slots arranged to enable separation of two decks of cards such that when the decks of cards is inserted into the enclosure, wherein cards aligning either on the first group of rods and slots, or align on the second group of rods and slots which are perpendicular to the first group of rods and slots; the cards are divided into separable plurality of cards with a lower group passing into the slots and an upper group resting on the top upper surface of the rods, enabling the upper group to be easily separated from the lower group. The slots are further configured: a plurality of said first group of rods and slots, and a plurality of said second group of rods and slots, such that the first group is wider than the rods and slots of the second group. The said rods are further configured: a plurality of rods wherein the said first group of rods and the said second group of rods, comprising of geometrically shaped, elliptical, rectangular, circular and square shapes. The said rods are further configured: wherein the plurality of said first group of rods, horizontal length side, is wider than the plurality of said second group of rods, vertical width side, second group of rods is congruent to first group. The rods and slots spacing, wherein both the said first group and the said second group of rods and slots, both receive equal card count, or thereabouts; playing cards of moderately played to heavily played (worn) condition are inserted for the said first group, and playing cards of new to slightly played (newer) condition are inserted for the second group, respectively. A water absorbent material (beverage coaster) on said bottom of apparatus wherein label, logo, marketing information about the said apparatus.

A plurality of rubber discs (non-skidmaterial) on top defined upper surface. A said top upper portion, comprising a rounded outer edge. The said top upper portion outer edge is rounded, ergonomically, for the purpose of resting hands on same surface as apparatus rest on. A method for shuffling playing cards comprising: providing an enclosure having, a top portion, a bottom portion and a plurality of spaced apart sidewalls, the top portion configured to enable the insertion of two decks of cards into the enclosure; a plurality of equally spaced apart substantially parallel rods extending perpendicular from base, wherein the rods each have an upper surface; slots arranged between pairs of rods, such that a slot spacing is defined by a spaced apart distance between associated pair of rods and wherein an upper surface of the rods are interleaved between the slots; Inserting the decks of cards into the enclosure; playing cards of moderately played to heavily played (worn) condition are inserted into the first group of slots wherein the said slots are wider. Playing cards of new to lightly played (newer) condition are inserted into the second group of slots that comprise the less wide (narrow) slots; the said narrow group of slots is perpendicular to the wider group of slots of the first group. Then manipulating (jiggle) the cards such that a first plurality of cards enters the slots and a second plurality of cards remains in a space defined by the upper surface of the rods. Separating the first plurality of cards from the second plurality of cards, then stacking the first plurality of cards on the second plurality of cards to regroup the deck of cards; and completing the shuffling of the deck of cards. For an advanced shuffle, stack the first plurality of cards in front of the second plurality of cards, reshuffle, then stack the first plurality of cards in back of the second plurality of cards, this allows the cards on both ends of the decks to get shuffled in. Repeating steps (b)-(g) at least one once. Also a configuration of slots wherein said playing cards of moderately played to heavily played (worn) condition are inserted into the first group of slots, wherein the said slots are wider; and playing cards of new to lightly played (newer) condition, are inserted into the second group of slots, wherein the said slots are less wide (narrow), said narrow group of slots are perpendicular to the wider group of slots. A plurality of rubber discs (non-skid material) on top defined upper surface orientated to align to said horizontal and said vertical rows of rods and slots. Comprising: a said top upper portion, comprising a logo, image on top of plurality rods on upper top surface Further comprising: a apparatus of various colors spray on and comprised in the mold-die making process. A bottom surface wherein a logo, and information is debossed. Comprising: wherein on side of apparatus indicates leveled marks to indicate one half deck of cards and a quarter deck of cards of new to lightly played cards and leveled marks to indicate one half deck of cards of moderately to heavily played cards

A SEQUENCE LIST OF DEVISE

Shuffle process commences when playing cards are inserted into an enclosure. Pivoting base of the apparatus for the proper alignment of card condition to rods/slots. Playing cards of new to lightly played (newer) condition are inserted into the enclosure aligning to (group A) slots and rods wherein the said slots and rods (top surface) is narrow. Playing cards of moderately played to heavily played (worn) condition are inserted into (group B) slots wherein the said slots and rods are wider. The rods and slots of (group A) are perpendicular to the rods and slots of (group B). Therefore pivoting apparatus may be necessary for the correct alignment. With deck of cards in hand, align cards edges vertically to slots and rods in the enclosure, use index finger and thumb of one hand holding edge side of deck, and use the index finger and thumb of the opposite hand holding opposite edge side of deck of cards. Slightly jiggle and manipulating the deck of cards such that a first plurality of cards enters the slots and a second plurality of cards remains in a space defined by the upper top surface of rods. The cards are divided into separable plurality of cards with a lower group passing into the slots and an upper group resting on the upper top surface of the rods enabling the upper group to be easily separated from the lower group separating the first plurality of cards from the second plurality of cards, stacking the first plurality of cards on the second plurality of cards to regroup the deck of cards, thus completing the shuffling of the deck of cards, at least one once. For an advanced shuffle, after cards have been separated, stack the first plurality of cards in front of the second plurality of cards, reshuffle, then stack the first plurality of cards in back of the second plurality of cards, this sequence allows the cards on both ends of the deck of cards, to get shuffled into the deck. Another accomplishment of the invention is the equal or thereabouts card count for cards of new to lightly played (newer) conditioned inserted into (group A) slots and cards of moderately played to heavily played (worn) condition inserted into (group B) slots. The ratio of cards resting on (group A) rods and the cards passing into the slots of (group A) is the same card count, there-abouts, as cards resting on the rods (group B) and the cards lowered into the slots of (group B) Therefore achieving a novel and uniqueness of the invention.

The invention claimed is:

1. A playing card shuffler apparatus comprising:

a block, hollowed, having an enclosure, a top portion, a bottom portion, and a plurality of sidewalls, the top portion configured to enable the insertion of two decks of cards into the enclosure;

a plurality of equally spaced apart rods extending perpendicular from base, wherein the rods each have an upper surface;

a plurality of said rods arranged wherein a plurality of a first group of rods is congruent to a plurality of a second group of rods;

the plurality of rods equally spaced apart, and said rods are geometrically shaped;

slots arranged between pairs of said rods, such that a slot spacing is defined by a spaced apart distance between associated pairs of rods and wherein an upper defined surface of the rods is interleaved between the slots; and the slots arranged to enable separation of two decks of cards such that when the decks of cards is inserted into the enclosure, wherein cards aligning either on the first group of rods and slots, or align on the second group of rods and slots which are perpendicular to the first group of rods and slots; the cards are divided into separable plurality of cards with a lower group passing into the slots and an upper group resting on the top upper surface of the rods, enabling the upper group to be easily separated from the lower group.

2. The apparatus of claim 1, wherein the said slots are further configured:

a plurality of said first group of rods and slots, and a plurality of said second group of rods and slots, such that the first group is wider than the rods and slots of the second group.

3. The apparatus of claim 1, wherein the said rods are further configured:

a plurality of rods wherein the said first group of rods and the said second group of rods, comprising of geometrically shaped, elliptical, rectangular, circular and square shapes.

4. The apparatus of claim 1, wherein the said rods are further configured:

wherein the plurality of said first group of rods, horizontal length side, is wider than the plurality of said second group of rods, vertical width side, second group of rods is congruent to first group.

5. The apparatus of claim 1, further comprising:

the rods and slots spacing, wherein both the said first group and the said second group of rods and slots, both receive equal card count, playing cards of moderately played to heavily played (worn) condition are inserted for the said first group, and playing cards of new to lightly played (newer) condition are inserted for the second group, respectively.

6. The apparatus of claim 1, further comprising:

a water absorbent material (beverage coaster) on said bottom of apparatus wherein label, logo, marketing information about the said apparatus.

7. The apparatus of claim 1, further comprising:

a plurality of rubber discs (non-skid material) on top defined upper surface orientated to align to said horizontal and said vertical rows of rods and slots.

8. The apparatus of claim 1, comprising:

a said top upper portion, comprising a logo, image on top of plurality rods on upper top surface.

9. The apparatus of claim 1, comprising:

an apparatus of various colors spray on and comprised in the mold-die making process.

10. The apparatus of claim 1, comprising:

a bottom surface wherein a logo, and information is debossed.

11. The apparatus of claim 1, comprising:

wherein on side of apparatus indicates leveled marks to indicate one half deck of cards and a quarter deck of cards of new to lightly played cards and leveled marks to indicate one half deck of cards of moderately to heavily played cards.

12. The apparatus of claim 1, comprising:

a said top upper portion, comprising a rounded outer edge.

13. The apparatus of claim 12, further comprising:

wherein the said top upper portion outer edge is rounded, ergonomically, for the purpose of resting hands on same surface as apparatus rest on.

14. A method for shuffling playing cards comprising:

(a) providing an enclosure having, a top portion, a bottom portion and a plurality of spaced apart sidewalls, the top portion configured to enable insertion of two decks of cards into the enclosure;

a plurality of equally spaced apart substantially parallel rods extending perpendicular from base, wherein the rods each have an upper surface;

slots arranged between pairs of rods, such that a slot spacing is defined by a spaced apart distance between associated pairs of rods and wherein an upper surface of the rods are interleaved between the slots; (b) inserting the decks of cards into the enclosure;

(c) playing cards of moderately played to heavily played (worn) condition are inserted into the first group of slots wherein the said slots are wider;

(d) playing cards of new to lightly played (newer) condition are inserted into the second group of slots that comprise the less wide (narrow) slots; the said narrow group of slots is perpendicular to the wider group of slots of the first group;

(e) manipulating (jiggle) the cards such that a first plurality of cards enters the slots and a second plurality of cards remains in a space defined by the upper surface of the rods;

(f) separating the first plurality of cards from the second plurality of cards;

(g) stacking the first plurality of cards on the second plurality of cards to regroup the deck of cards; and (h) completing the shuffling of the deck of cards;

i) for an advanced shuffle, stack the first plurality of cards in front of the second plurality of cards, reshuffle, then stack the first plurality of cards in back of the second plurality of cards, this allows the cards on both ends of the decks to get shuffled in.

15. The method of claim 14 for further comprising repeating steps (b)-(g) at least one once.

16. The apparatus of claim 9 further comprising:

a configuration of slots wherein said playing cards of moderately played to heavily played (worn) condition are inserted into the first group of slots, wherein the said slots are wider, and playing cards of new to lightly played (newer) condition, are inserted into the second group of slots, wherein the said slots are less wide (narrow), said narrow group of slots are perpendicular to the wider group of slots.

* * * * *